US007395584B2

(12) United States Patent
Khalifa et al.

(10) Patent No.: US 7,395,584 B2
(45) Date of Patent: Jul. 8, 2008

(54) HERMAPHRODITIC CONNECTOR

(75) Inventors: Aly Khalifa, Raleigh, NC (US); Shih-Sheng Yang, Taipei (TW)

(73) Assignee: Universal Trim Supply Co., Ltd., Taipei Hsien (TW)

( * ) Notice: Subject to any disclaimer, the term of this patent is extended or adjusted under 35 U.S.C. 154(b) by 0 days.

(21) Appl. No.: 11/656,784

(22) Filed: Jan. 23, 2007

(65) Prior Publication Data

US 2007/0178732 A1 Aug. 2, 2007

Related U.S. Application Data

(60) Provisional application No. 60/763,115, filed on Jan. 27, 2006.

(51) Int. Cl.
*A44B 19/00* (2006.01)

(52) U.S. Cl. ..... 24/590.1; 439/288

(58) Field of Classification Search ..... 439/288–290; 24/590.1, 586.11, DIG. 38, DIG. 53, DIG. 54, 24/DIG. 56

See application file for complete search history.

(56) References Cited

U.S. PATENT DOCUMENTS

| | | | | |
|---|---|---|---|---|
| 2,867,025 | A * | 1/1959 | Aler | 24/590.1 |
| 3,520,033 | A * | 7/1970 | Usuda | 24/590.1 |
| 5,530,998 | A * | 7/1996 | Hurst et al. | 24/590.1 |
| 5,865,638 | A * | 2/1999 | Trafton | 439/288 |

* cited by examiner

*Primary Examiner*—Neil Abrams
(74) *Attorney, Agent, or Firm*—Leong C. Lei

(57) ABSTRACT

A connection system for securing two articles to each other having two connectors, each of connectors includes a base plate with a center point and identical inter-engaging sections with at least one male component and at least one female component. Also provided is a connection region for securing the connector to an article. Male and female components are radially disposed equidistant around the center point of the base plate and the connection region is disposed circumferentially around the male and female components. The connectors are engaged by rotating each connector such that the male and female components of each connector interlock with each other.

10 Claims, 27 Drawing Sheets

HERMAPHRODITIC CONNECTOR

CROSS-REFERENCE TO RELATED APPLICATIONS

This application claims the priority of provisional application Ser. No. 60/763,115 filed in the United States Patent and Trademark Office on Jan. 27, 2006.

BACKGROUND OF THE INVENTION

The invention is generally directed to a hermaphroditic connector for coupling in a controllably releasable fashion two objects, and, in particular, to a modular system based on a hermaphroditic connector in which one of the connectors, which includes both male and female connection components, is affixed to a garment or bag in a permanent fashion and a series of other objects coupled to another of the hermaphroditic connectors can be selectively coupled and decoupled from the garment or bag by locking the two connectors together or unlocking them.

One of the needs that has grown particularly in the garment area is the desire for modular connection systems to be used to connect various different types of items to jackets, backpacks and other garments and also to containers so that their functionality can be enhanced and the electronics and other small items which form a part of our daily lives can be affixed securely to a garment or container.

One of the major problems associated with connectors of this sort is their reliability, ease of use, an ability to be modularly configured with a garment or container and then adapted to be coupled easily and securely to other items which are to be affixed to the garment or container. Accordingly, there is a need for an improved connection system to secure two items together in a reliable, secure, compact and releasable fashion which is also relatively intuitive to use and can be operated under less than ideal conditions such when as wearing gloves or in extreme cold.

SUMMARY OF THE INVENTION

The invention is generally directed to a connection system utilizing a pair of hermaphroditic connectors, each of which includes a connection section for permanently or semi-permanently coupling the connector to a first item to be joined and a second, engaging section which includes at least one male component and one female component on each connector. The second connector is similar or identical to the first connector and is adapted to be secured permanently or semi-permanently to a second item to be joined to the first item. The first and second connectors are joined by placing them in proximity to each other and then rotating the connectors relative to each other so that the male and female components of the connectors interlock and then lock each other together so that the two connectors become locked together, thereby maintaining the two items together. The locking connection can be released by rotating the two connectors relative to each other in the opposite direction from which they were rotated to form the lock.

Accordingly, it is an object of the invention to provide a suitable hermaphroditic connection system in which the same connector piece can be used on all of the items which are to be connected to each other and any two can be secured to each other.

Still another object of the invention is to provide an improved connection system which can be sewn to a garment or bag to provide a fixed base for connection of a variety of different items to the garment or container.

Still another object of the invention is to provide a connection system which is lightweight, secure and releasable which provides a thin profile connection between two items to be held together.

Still other objects and advantages of the invention will, in part, be obvious and will, in part, be apparent from the specification.

The invention accordingly comprises the features of construction, combinations of elements and arrangements of parts which will be exemplified in the construction as hereinafter set forth, and the scope of the invention will be indicated in the Claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
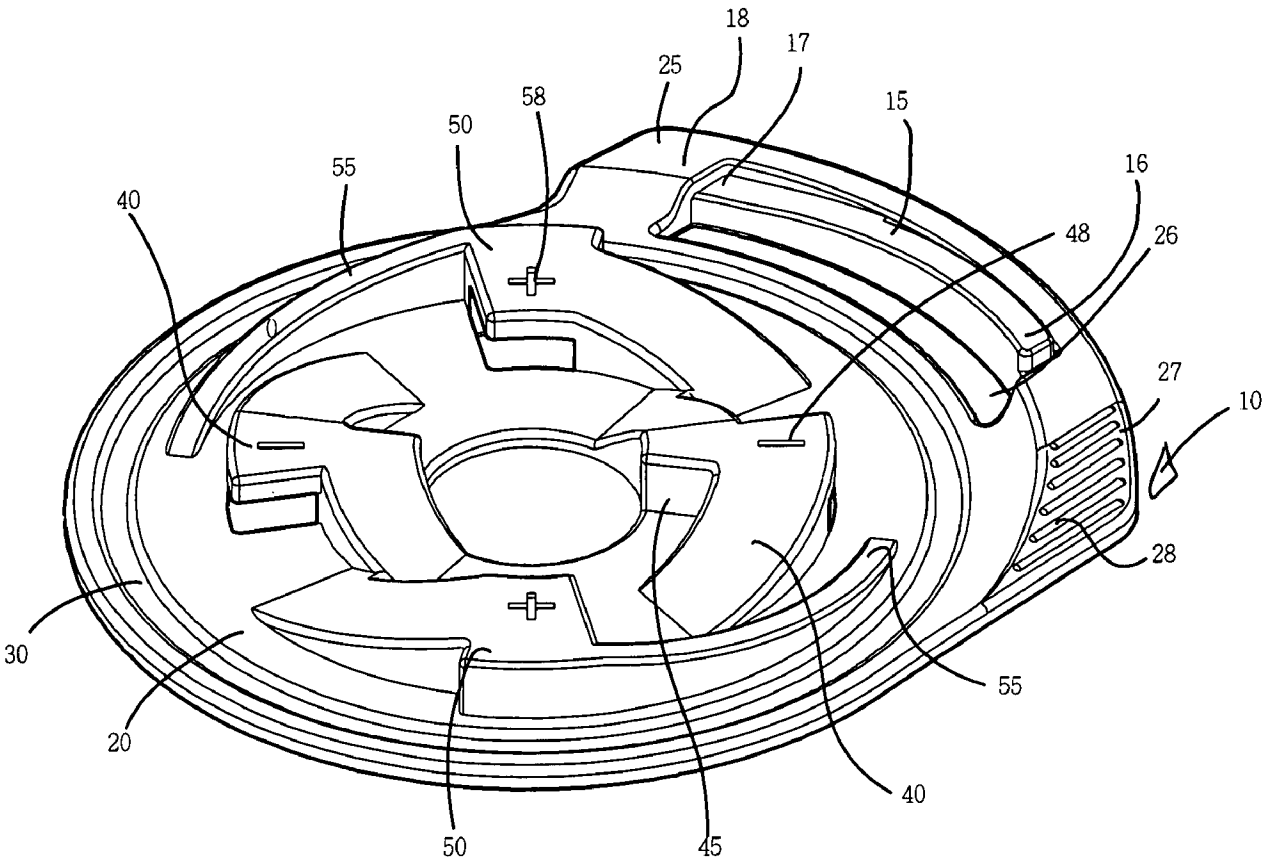
FIG. 1 is a perspective view of a hermaphroditic connector constructed in accordance with a first preferred embodiment of the invention.

Reference is first made to FIGS. I and 2 wherein a connector 10 constructed in accordance with a preferred embodiment of the invention is depicted. The connection system for securing two articles to each other having two connectors 10, each of connectors 10 includes a base plate 20 with a center point and identical inter-engaging sections with at least one male component 40 and at least one female component 50. Also provided is a connection region 30 for securing the connector to an article. Male and female components 40, 50 are radially disposed equidistant around the center point of base plate 20 and connection region 30 is disposed circumferentially around the male and female components. In this embodiment, connector 10 further includes an outer connection tab 25 around a portion of the base plate here shown with one pre-cut slot 26 allowing for additional security of the connection either by using cabling or Velcro®. Connection tab 25 also includes a release flange 27 having elongated raised hatch marks 28 disposed on one edge of the connection tab. Above opening 26 a ramp 15 is provided to further lock the connectors together. Ramp 15 contains a raised locking end 16 and a lowered engagement end 17. The wall above lower engagement end 17 contains a lip 18 for locking the raised locking end 16 in place. When the connectors are rotated in a clockwise manner, ramps 55 guide the connectors into place and ram 15 snaps into place with lip 18. To release, overhang tab is pulled away outwards, away from the connection area such that the connectors can be turned for unlocking.

Outer connection region 20, which is a connection portion, can either be sewn, inserted from the inside of the garment so that only the central connection portion is exposed or other connection means. Depending upon the application the size of the connector can be varied from relatively small to a larger size. In current preferred embodiments, the connector is an injection molded piece made of a suitable plastic material. With current sewing technology it is not problematical to sew directly through the injection molded piece to affix it in place in the garment or container.

Figure 2:
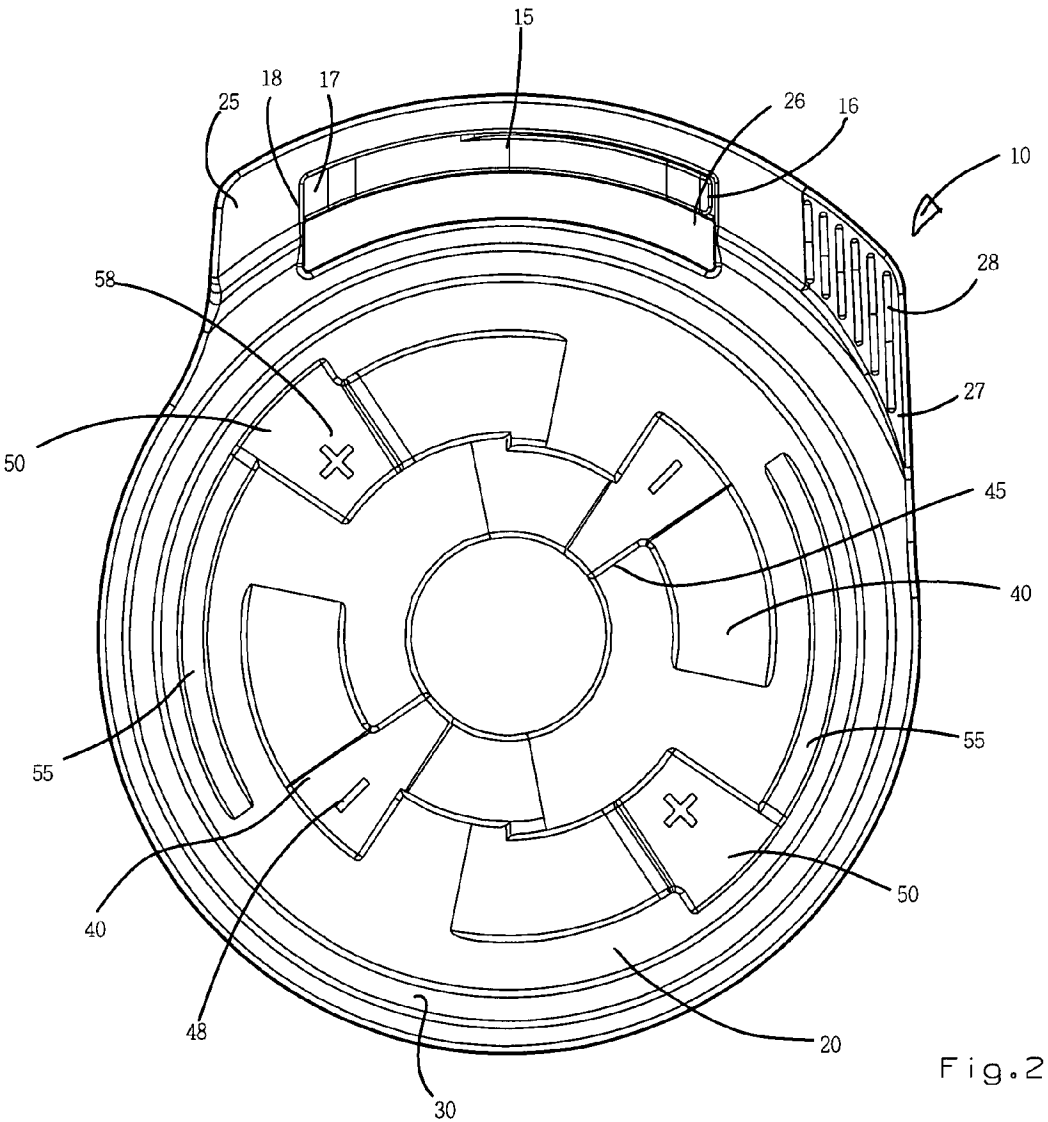
FIG. 2 is a top plan view of the hermaphroditic connector of FIG. 1.

Again, with reference to FIGS. 1 and 2, the central interlocking section in this embodiment includes at least a pair of connector elements 40 and 50, in this Figure two pairs of connector elements are shown. The connector elements are of two types, one of which can be generally called a male component 40 and the other a female component 50. The distinguishing characteristic of what is identified as the male component is the presence of a radially inwardly oriented section 45 not found in the female component. The female components appear as a single curved ramp member terminating at the end of the arc of the ramp, whereas the male components essentially make an inwardly oriented turn towards the center of the connector. Also provided, as shown in FIGS. 1 and 2 is the addition of at least one ramp 55, in this case two, to the along the outer surface at the end of the female connector. The addition of this ramp assists in the mating of the two connectors. When placing the connectors together, if the ramps are not aligned properly, the connectors have a tendency to slide around until the proper alignment is made. This ramp element facilitates the proper positioning and helps prevent sliding of the two connectors.

Also, as can be seen in FIGS. 1 and 2, the interior surfaces of the male and female components have positive 58 and negative 48 locking elements. Thus, additional effort beyond that to lock the two connectors together is required to disengage them. This serves several purposes, including reliability and avoidance of inadvertent disengagement when not intended. Various types of mechanisms can be utilized to accomplish this lock device, such as a raised element for the positive element and a detent for the negative.

Figure 3:
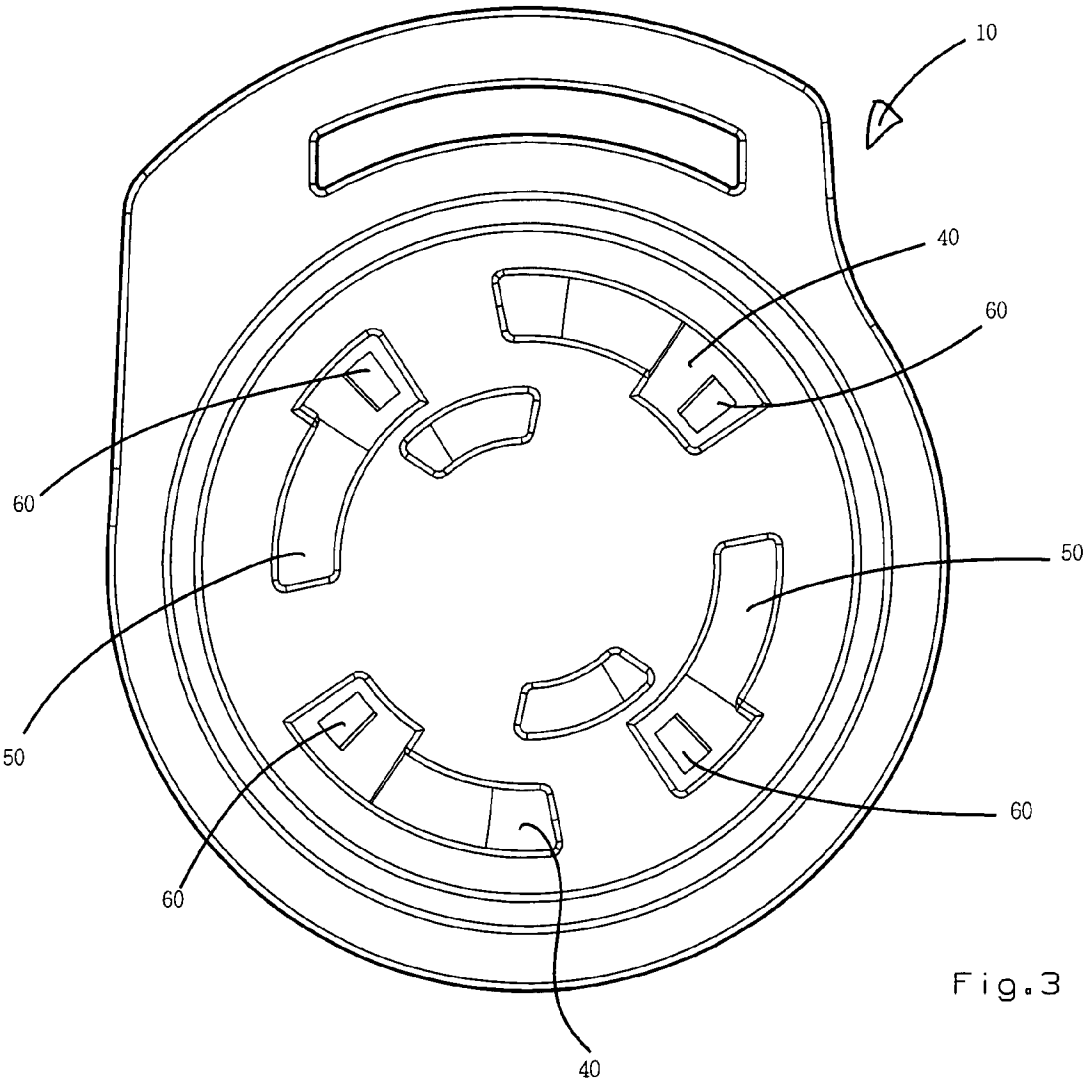
FIG. 3 is the bottom plan view of the hermaphroditic connector of FIGS. 1 and 2.

FIG. 3 shows a bottom plan view of a single connector 10. A rectangular detent 60 is provided on the bottom portion of each male 40 and female 50 ramp member. Detent 60 provides a positive locking sensation when attaching the two connectors. Many other shapes could be used to attain this positive locking feeling. This sensation prevents overturning of the connectors. Other embodiments of this positive locking device could be providing a negative element on the male ramp member and a positive on the female ramp member as discussed above.

Figure 4:
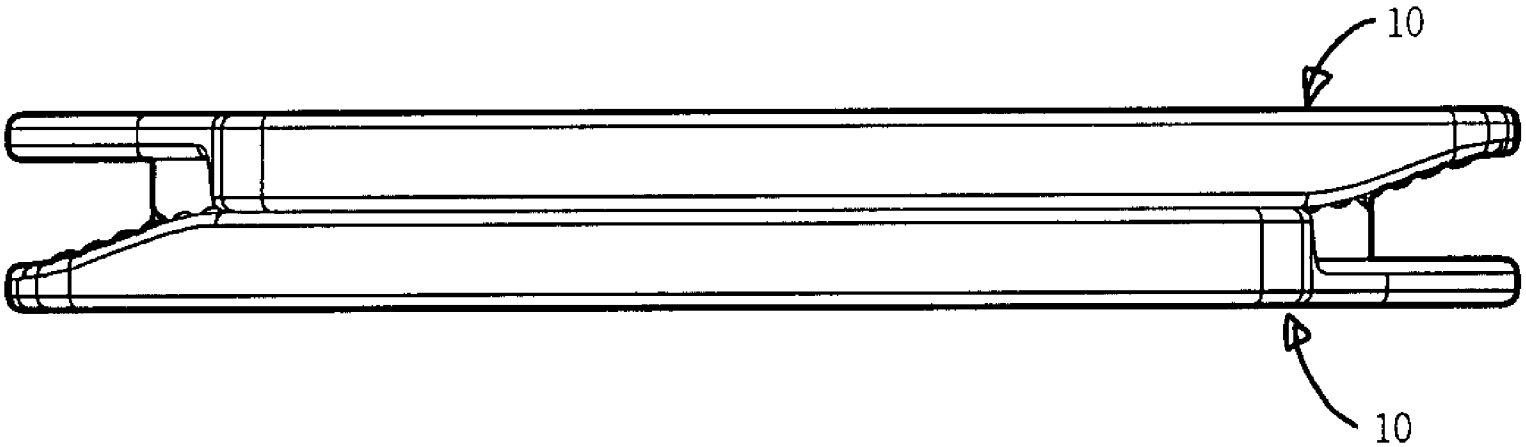
FIG. 4 is a side view of two connectors aligned and engaged together.
Figure 5:
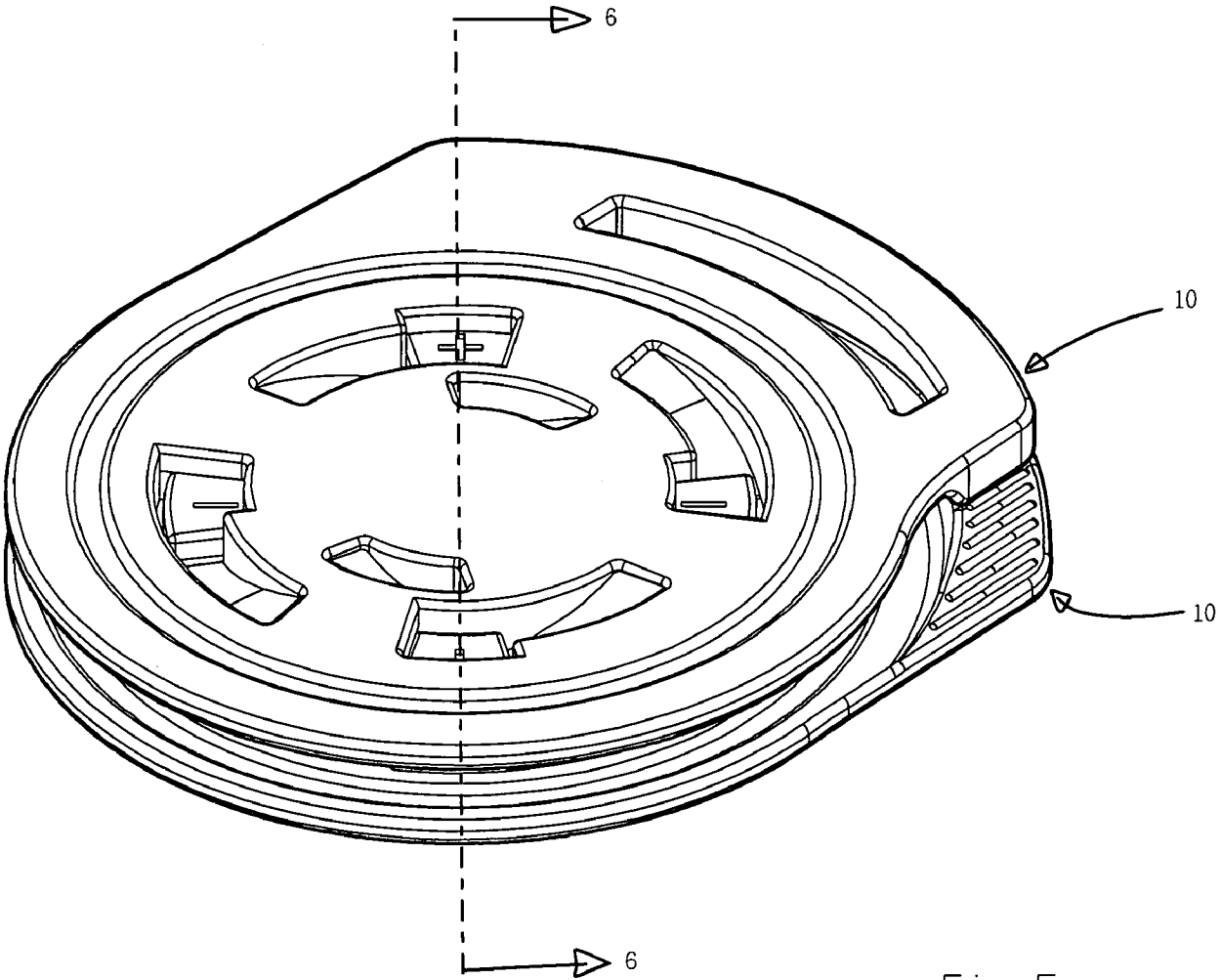
FIG. 5 is a perspective view of two connectors in the engaged, locked position.
Figure 6:
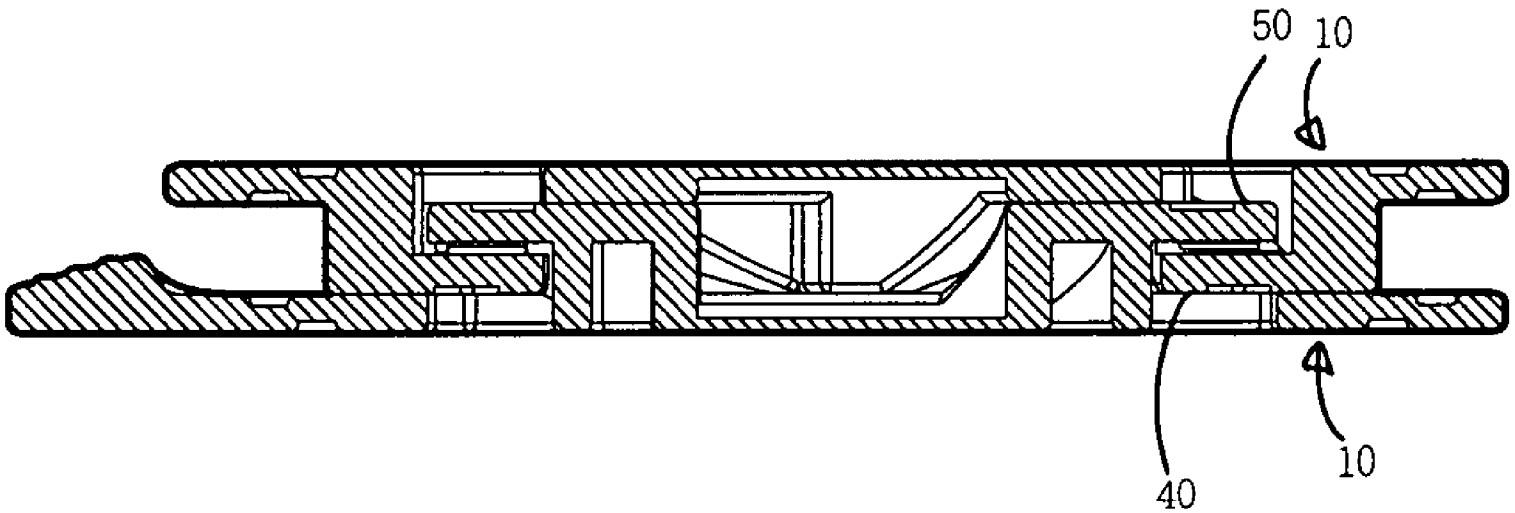
FIG. 6 is a cross sectional view along the lines 6-6 of the two connectors in FIG. 5 the engaged, locked position.

Reference is made to FIGS. 4, 5 and 6, which show the way in which the male 40 and female 50 components interact when the two connectors are rotated with respect to each other. When the two connectors are in relatively close proximity prior to being inter-engaged, the user would press the two connectors generally against each other and then rotate them so that male 40 and female 50 connector would engage and then lock in place as shown particularly in FIGS. 5 and 6.

Figure 7:
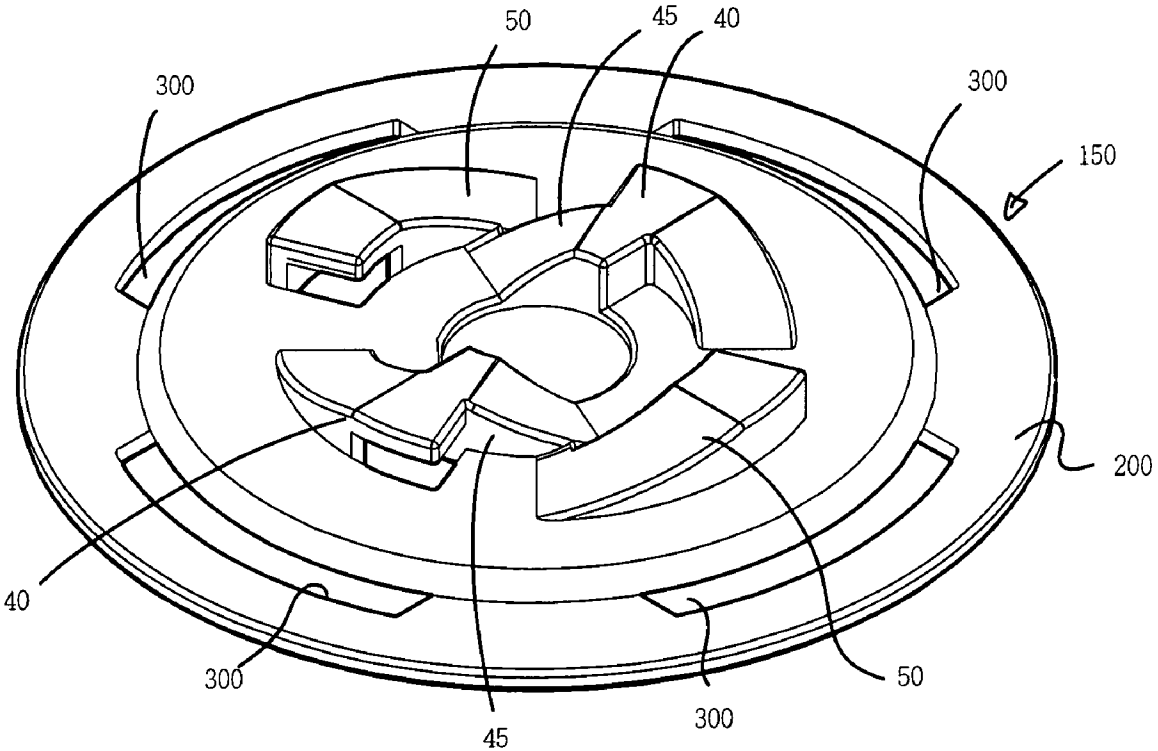
FIG. 7 is a perspective view of a connector constructed in accordance with another preferred embodiment of the invention.
Figure 8:
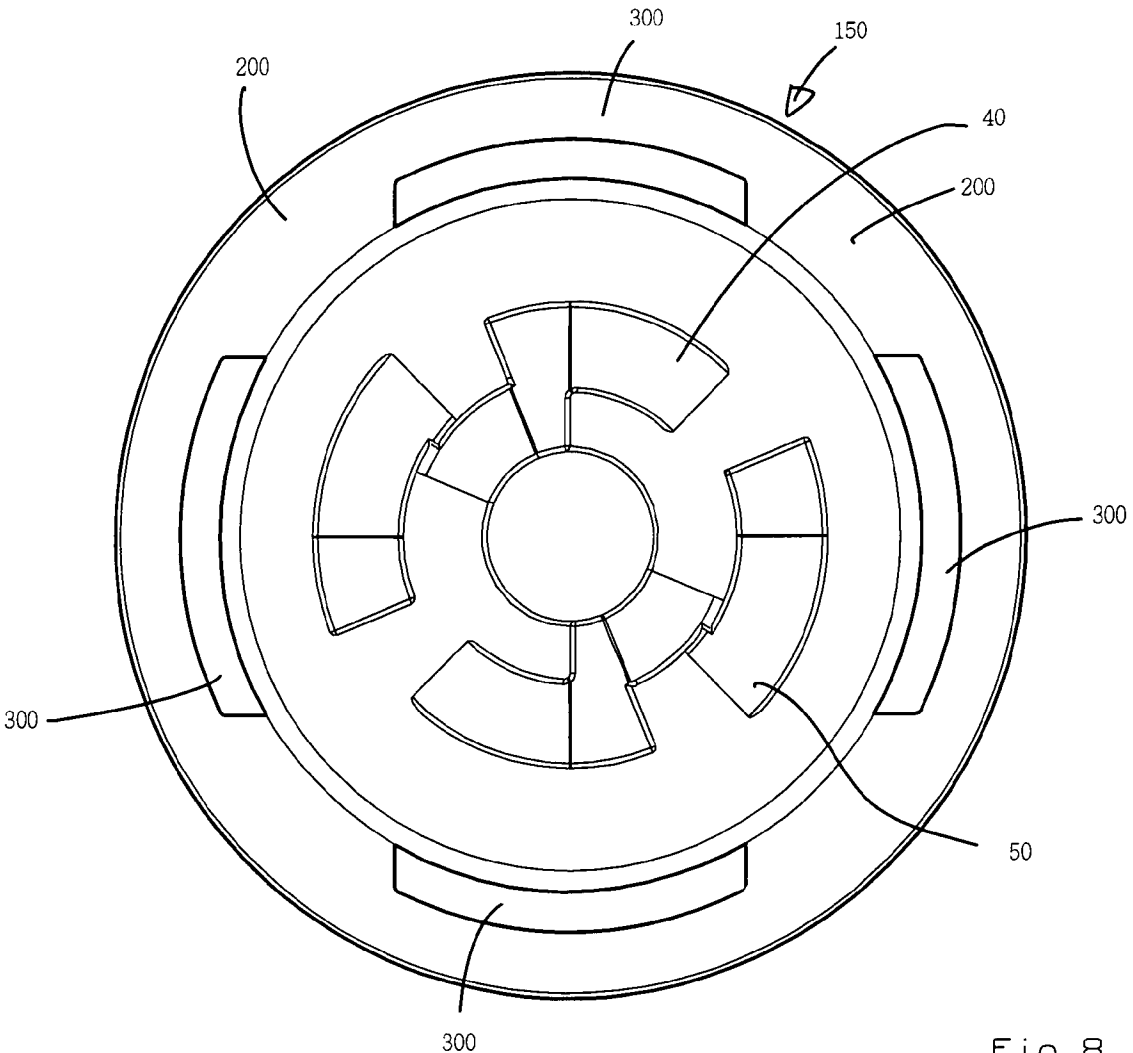
FIG. 8 is a top plan view of the connector of FIG. 7.
Figure 9:
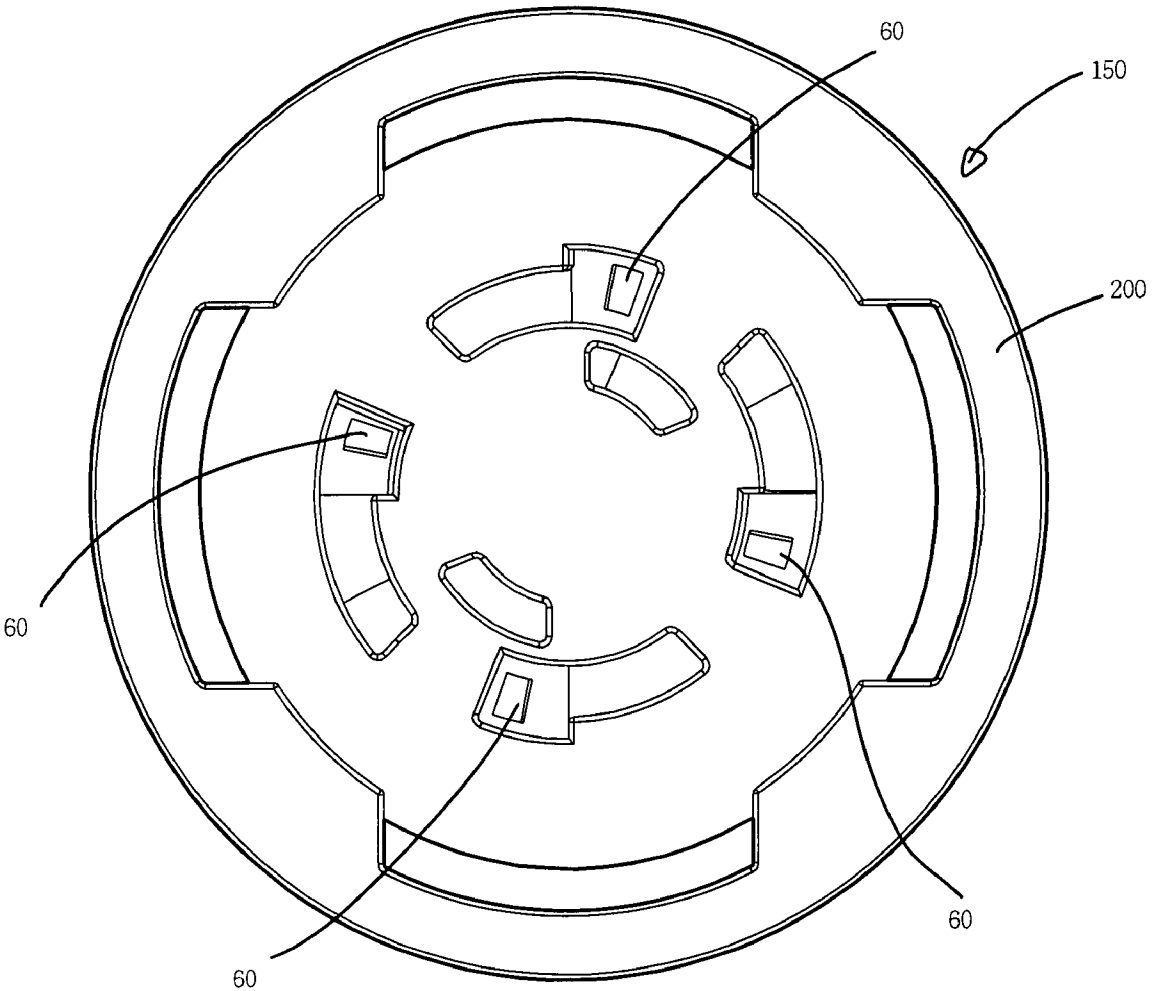
FIG. 9 is a bottom plan view of the connector of FIG. 7.
Figure 10:
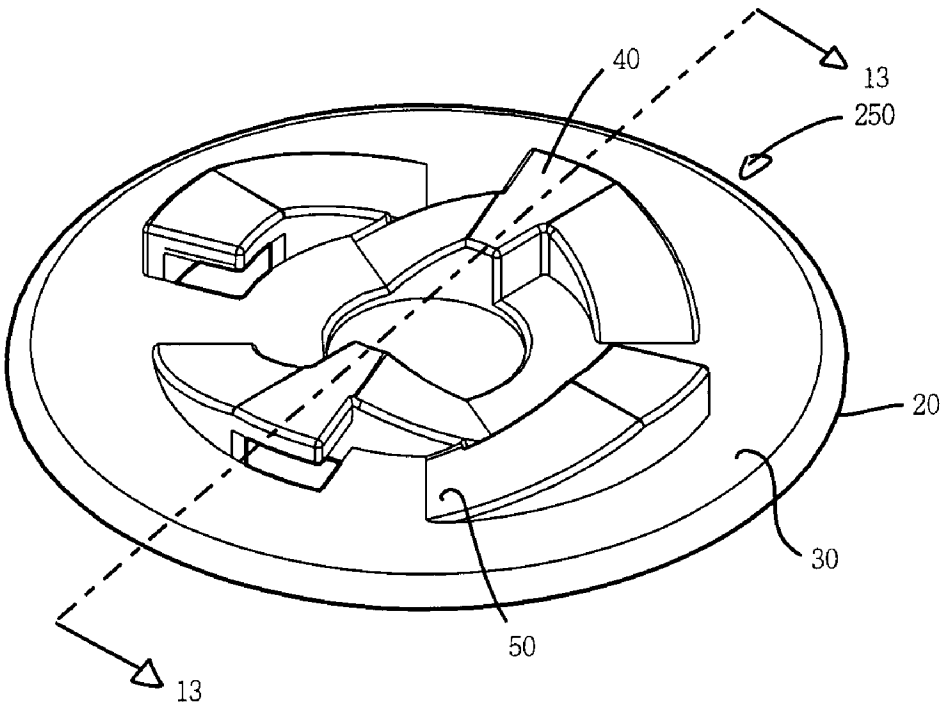
FIG. 10 is a perspective view of a connector constructed in accordance with yet another preferred embodiment of the invention.
Figure 11:
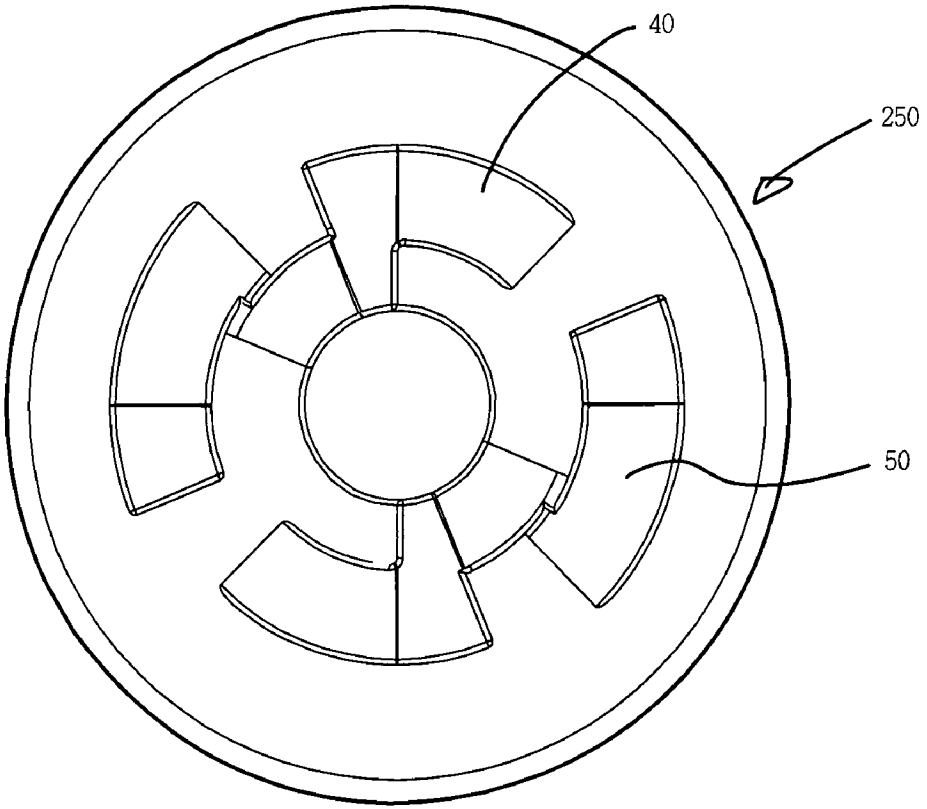
FIG. 11 is a top plan view of the connector of FIG. 10.
Figure 12:
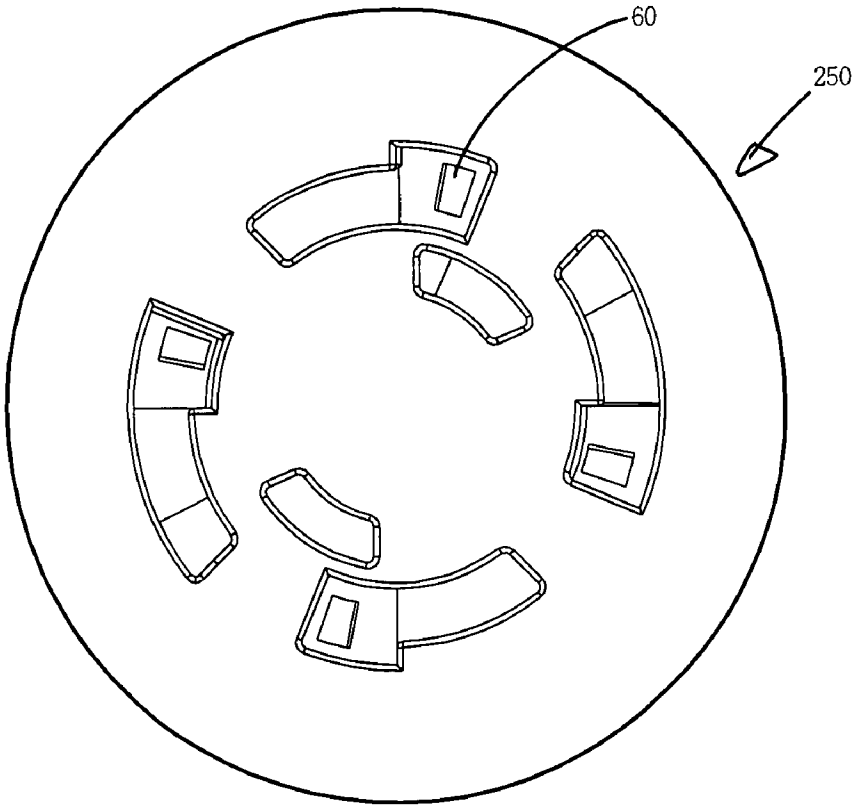
FIG. 12 is a bottom plan view of the connector of FIG. 10.

Reference is first made to FIGS. 7-9 wherein connector 10 is constructed in accordance with another preferred embodiment of the invention is shown. Connector includes 10 an outer connection collar 200 disposed around the entire base plate being a having a greater radius from the center point of the base plate than the male and female components. Outer connection collar 200 includes a series of pre-cut slots 300 around the outer perimeter of connector 10. Outer connection collar is also used to secure the connector to the item to which it is to be secured and is also used to secure the two connectors together to prevent rotation of the connectors.

FIGS. 7-9 also contain the central interlocking section including at least a pair of connector elements 40 and 50, in this Figure two pairs of connector elements are shown. The connector elements are of two types, one of which can be generally called a male component 40 and the other a female component 50. Again, the distinguishing characteristic of what is identified as the male component is the presence of a radially inwardly oriented section 45 not found in the female component. FIG. 9 shows a bottom plan view of a single connector 150. Rectangular detent 60 is provided on the bottom portion of each male 40 and female 50 ramp member.

Figure 13:
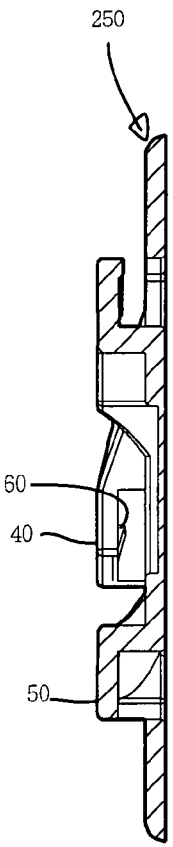
FIG. 13 is a cross sectional view along the lines 13-13 of the connector of FIG. 10.
Figure 14:
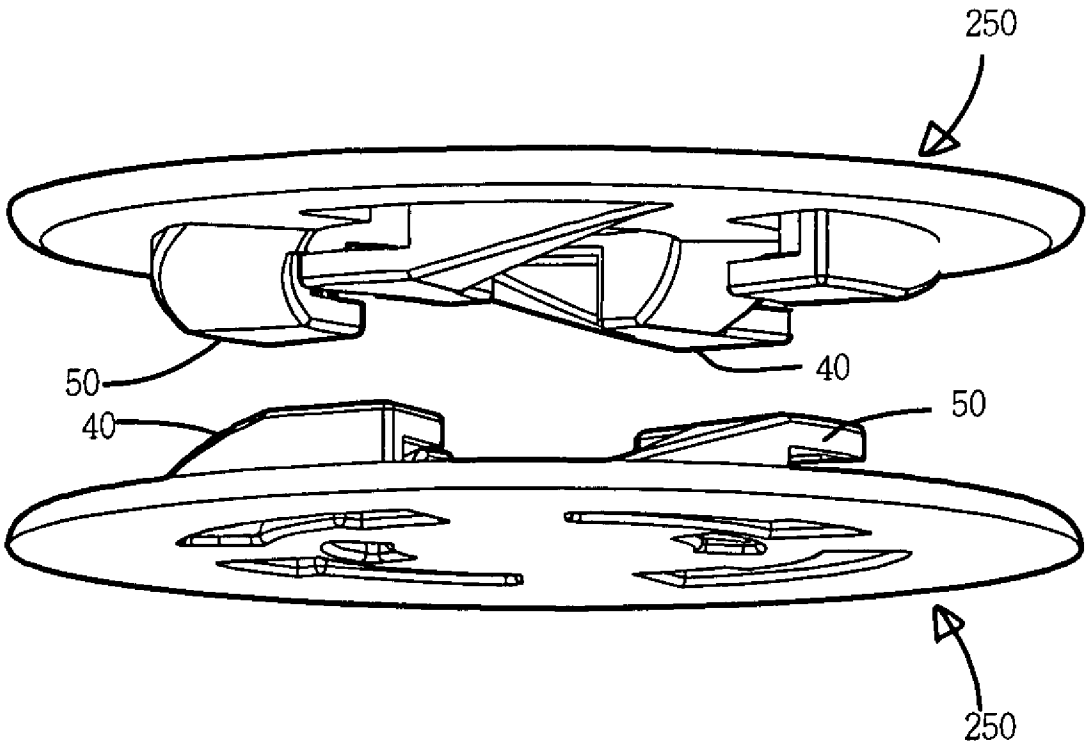
FIG. 14 is a side view of two connectors as shown in FIG. 10 aligned to be engaged.
Figure 15:
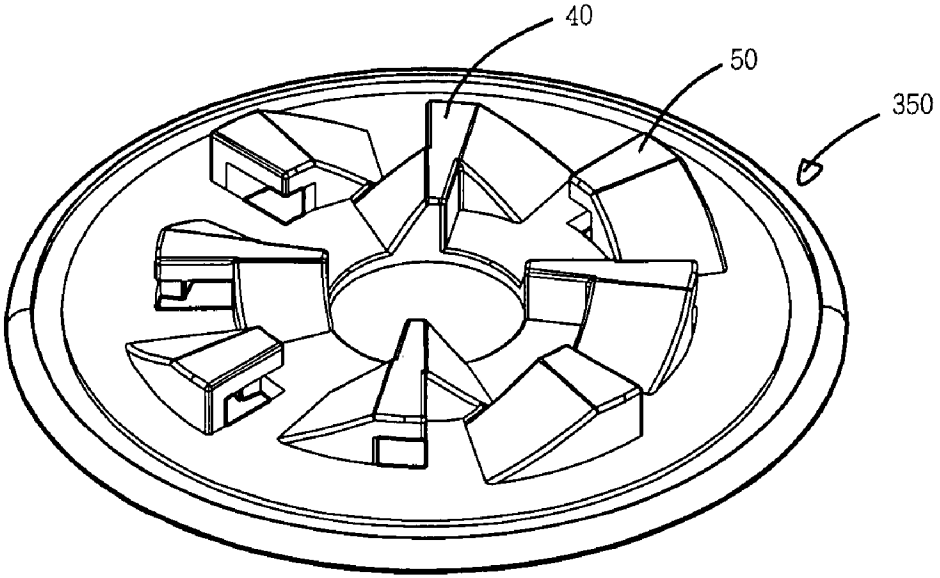
FIG. 15 is a perspective view of a connector constructed in accordance with another embodiment of the invention.
Figure 16:
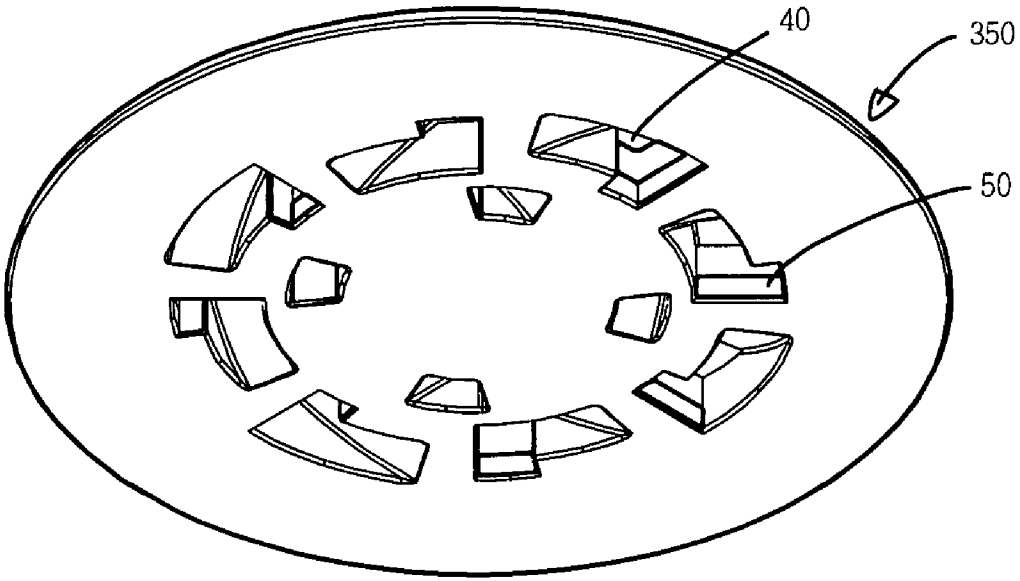
FIG. 16 is a bottom plan view of the connector of FIG. 15.

Reference is made now to FIGS. 10-14 which show another embodiment of the present invention. In this embodiment, connector 250 does not include the outer connection region and would require stitching directly through the plastic rather than utilizing the open curved slots in the embodiments of FIGS. 1-9. Functionally, the engaging portion in the center is the same. FIG. 13 shows a cross sectional view of the connector of FIG. 10. FIG. 14 shows two connectors of the embodiment shown in FIG. 10 in relatively close proximity prior to being inter-engaged, the user would press the two connectors generally against each other and then rotate them so that male 40 and female 50 connector would engage and then lock in place.

Figure 17:
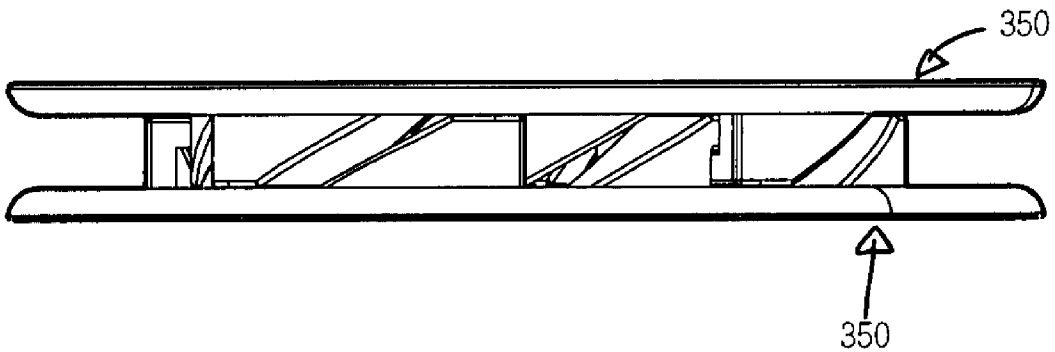
FIG. 17 is a side view of two connectors as shown in FIG. 15 in the engaged, locked position.
Figure 18:
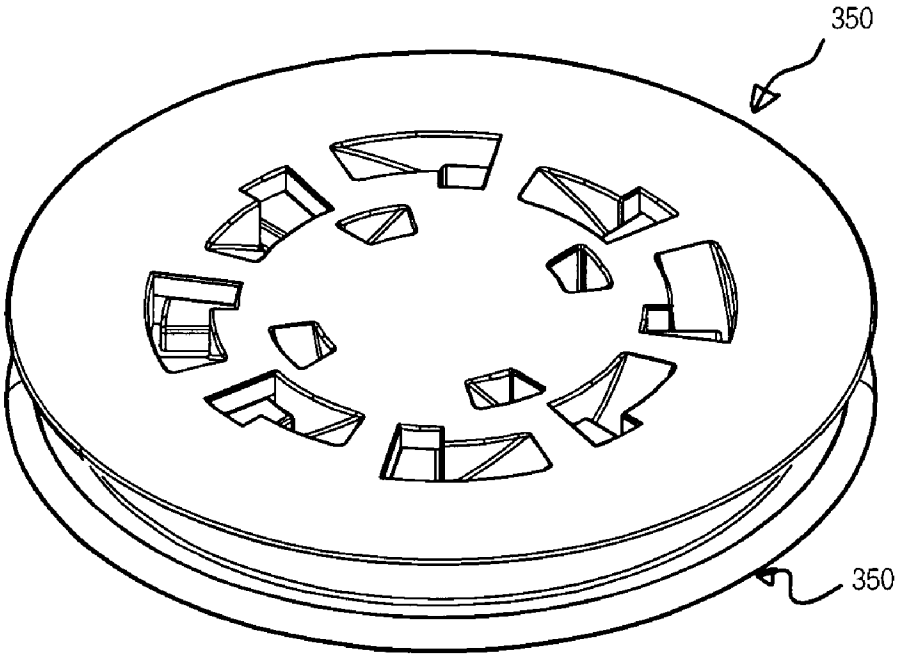
FIG. 18 is a perspective view of two connectors as shown in FIG. 15 in the engaged, locked position.
Figure 19:
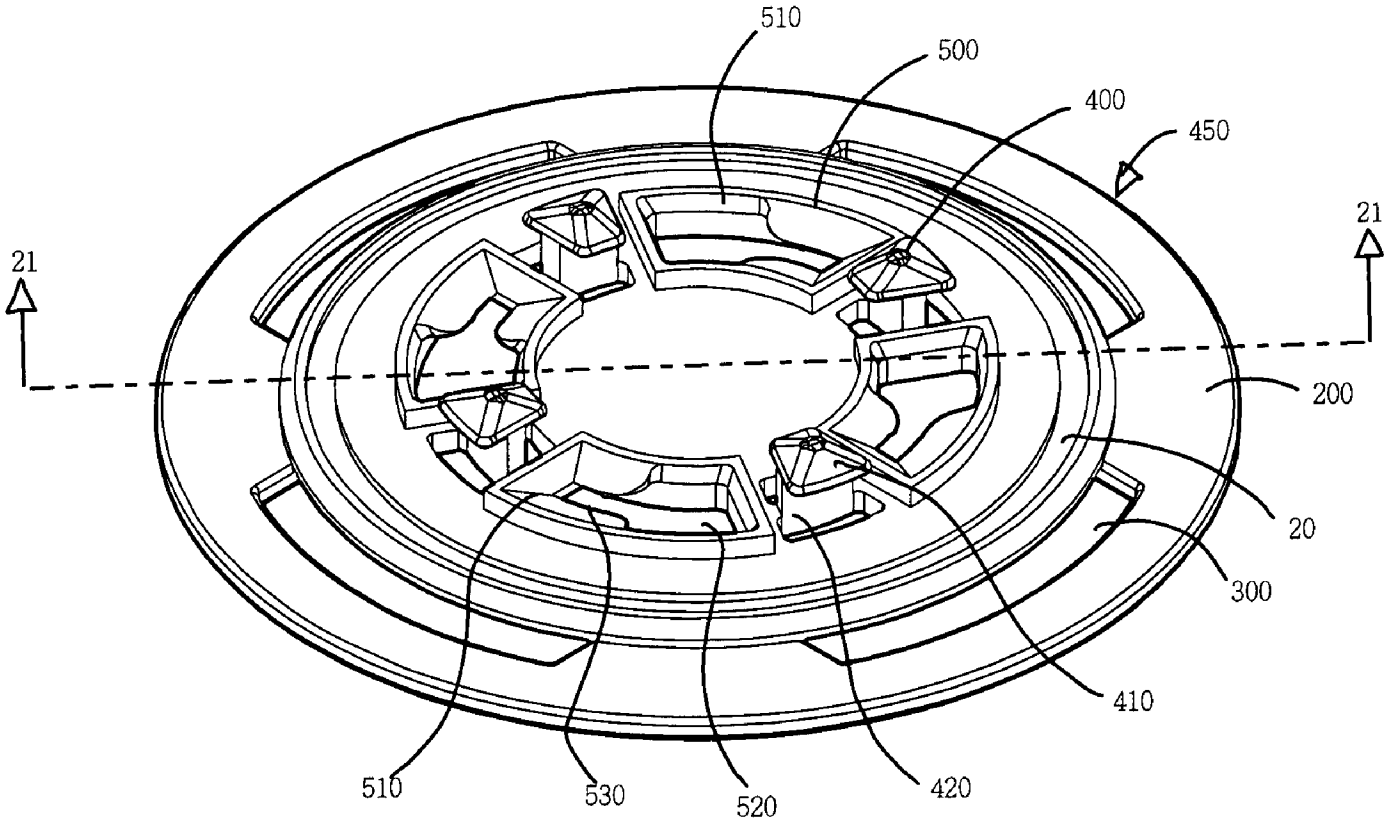
FIG. 19 is a perspective view of a connector constructed in accordance with a further embodiment of the invention.
Figure 20:
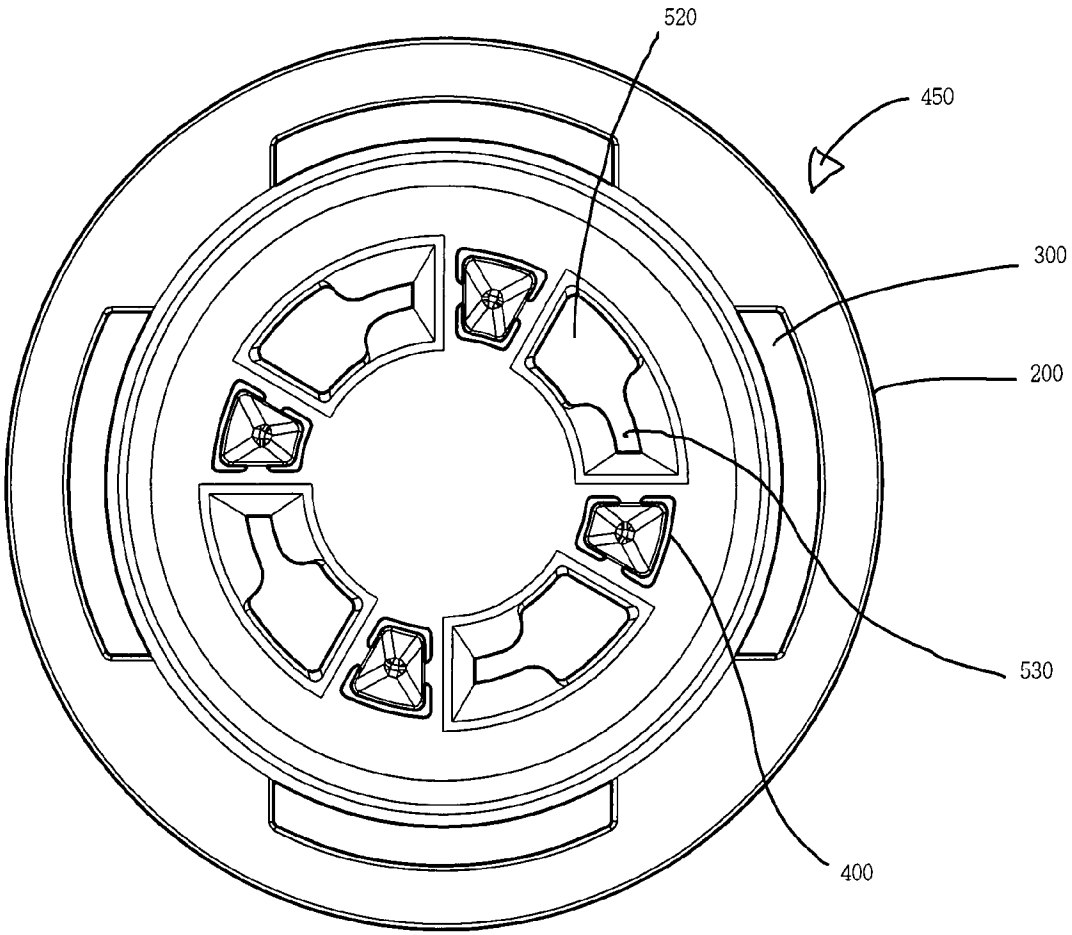
FIG. 20 is a top plan view of the connector of FIG. 19.
Figure 21:
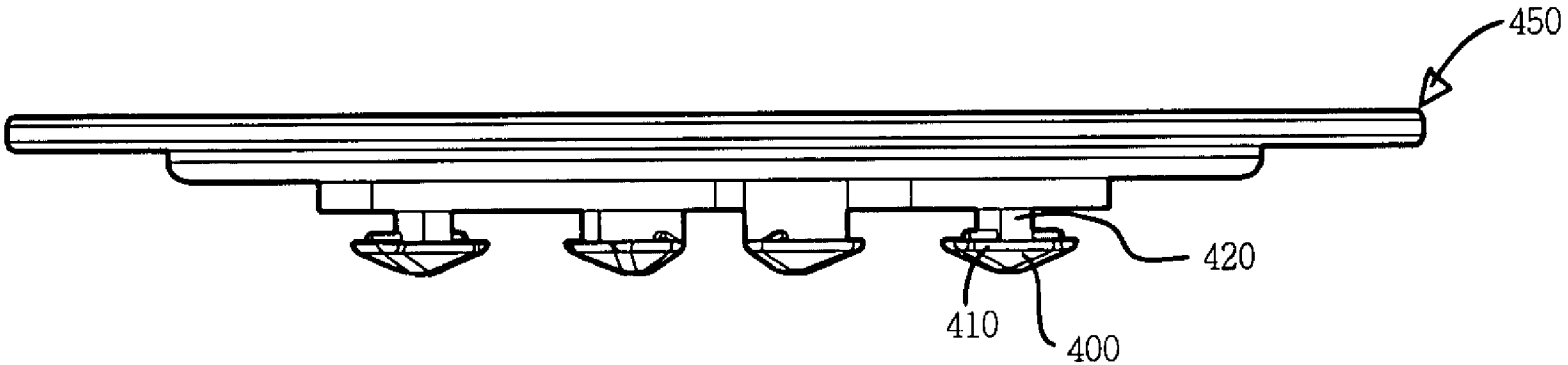
FIG. 21 is a cross sectional view along the lines 21-21 of the connector of FIG. 19.
Figure 22:
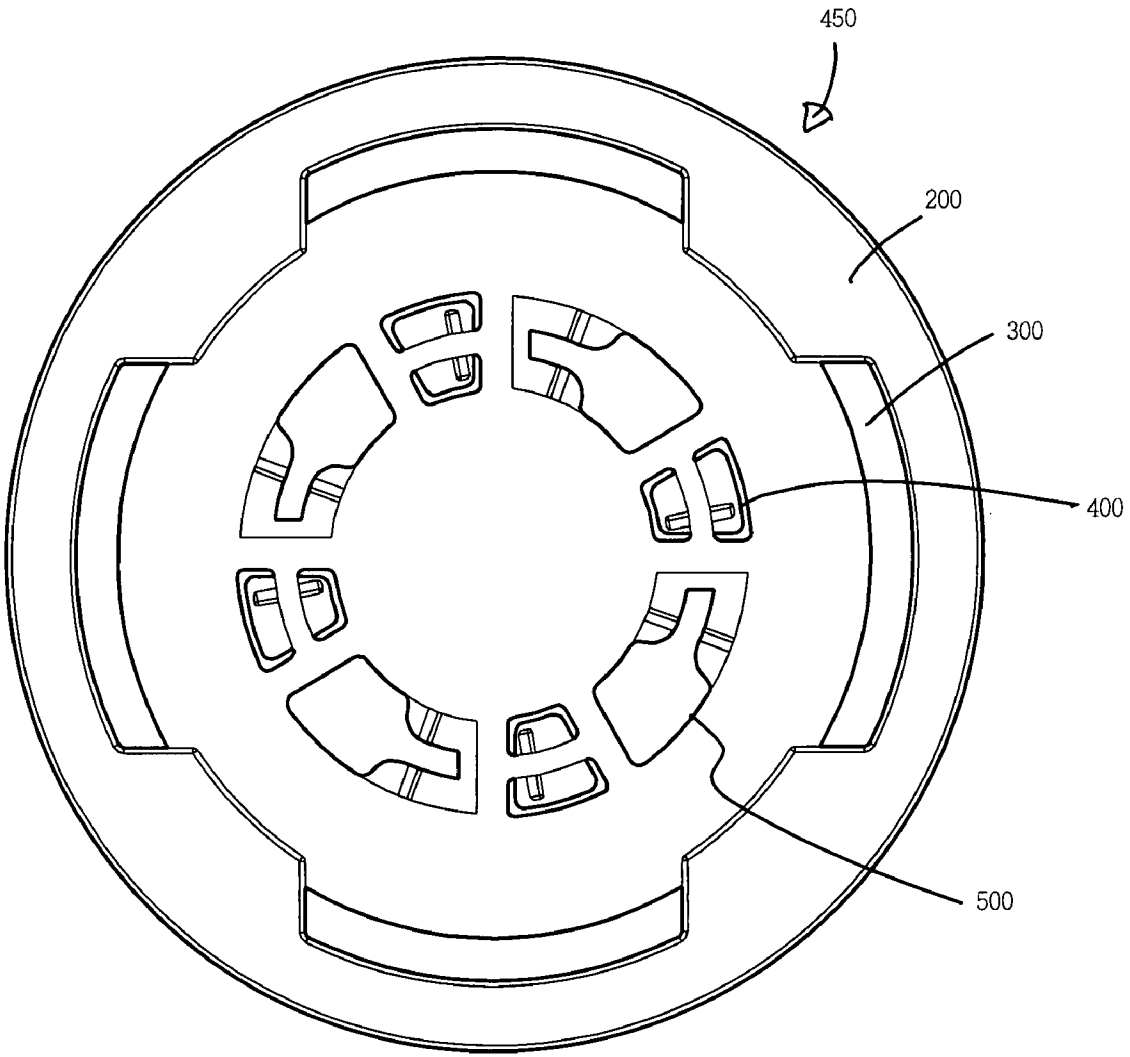
FIG. 22 is a bottom plan view of the connector of FIG. 19.
Figure 23:
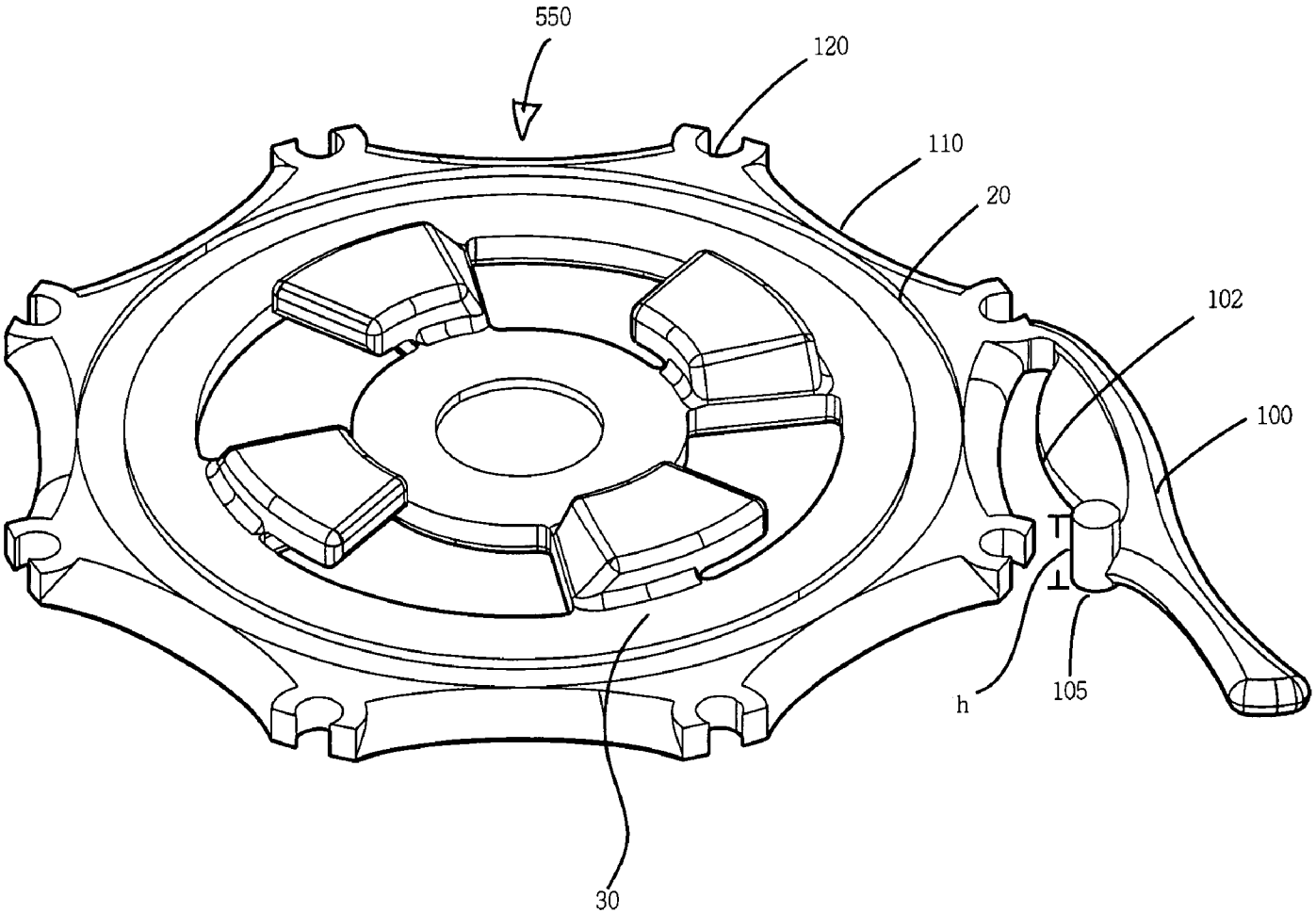
FIG. 23 is a perspective view of a different connector including a locking mechanism constructed in accordance with another preferred embodiment of the invention.
Figure 24:
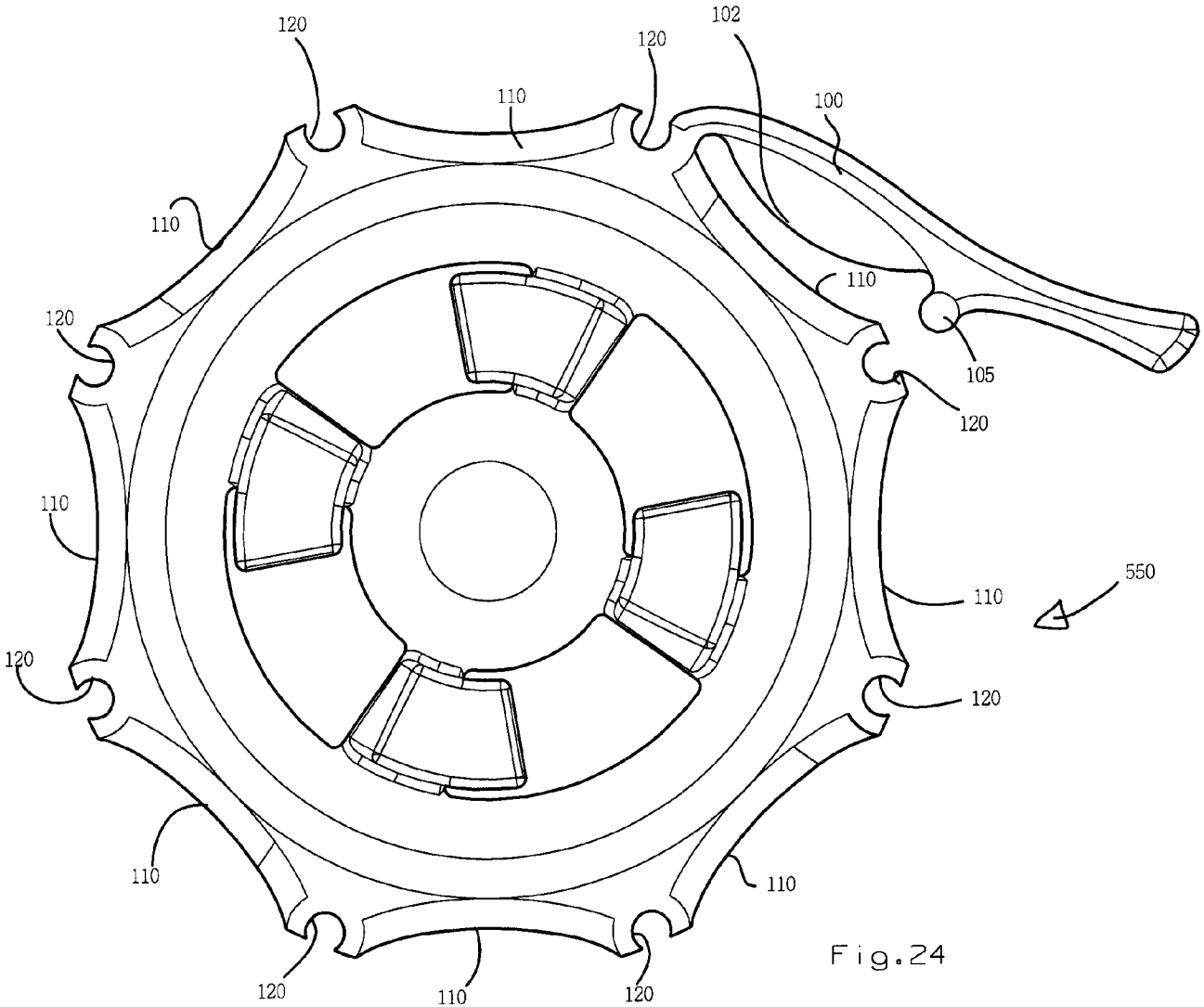
FIG. 24 is a top plan view of the connector of FIG. 23.

Reference is next made to FIGS. 15-18 in which an alternate embodiment of a hermaphroditic connector 350 constructed in accordance with another preferred embodiment of the invention is depicted. In the connector of FIGS. 15-18 there are four male and four female connection elements spread out around the connector. Apart from the number of connection elements the connections elements themselves are the same, though reduced in size and scale due to the need to fit in more connection elements within the circle of connection elements. The angular distance to be traveled by adjoining connectors as shown in FIGS. 17 and 18 to engage and lock is shorter than that for the earlier embodiments in which only four connection elements are used.

One could use two different types of connectors with complementary connection elements, rather than the same alternating blend of male and female connection elements. However, additional adjustments would have to be made and the modularity of the system would be compromised.

In some applications, the larger embodiment with the slots around the perimeter can be used more easily to connect to an item to be held, either as part of a permanent installation in a jacket or bag or two a small container, such as a cell phone case or digital camera case. In practice, the two different types of connectors can be used in any combinations. The essential inter-engaging portion in the center is the same and can be sized to match. It is critical that the number, orientation and size of the engaging components found on one of the two connectors be the same as those found on the other connector. While the connectors shown all include four connection elements, two male and two female, it is possible to use more or less of these components. For example, using six or eight connectors could work as well, with the effect of increasing the number of connection elements, shrinking the arc through which the connectors must be turned to lock or unlock the connectors. Also, when one begins to connect the two connectors the alignment of the connector elements relative to those on the other connector is not generally known, nor is it necessary that the user pre-align the connectors. Instead, merely by turning the connectors relative to each other within a limited arc of rotation, the appropriate connectors will align and then interlock. With the greater number of connection elements the angular distance traveled before the engagement takes place is reduced. However, the trade-off is that the alignment of the two connectors must be more precise to assure that the appropriate engagement can take place.

FIGS. 19-22 show another embodiment of the present invention. In this embodiment, connector 450 also contains both a male connector 400 and a female connector 500. In this case, male connector 400 consists of an elongated member, preferably mushroom-like shaped, having a head portion 410 and a stem portion 420. Female connector 500 contains a receiving volume 510 that is constructed to accept male connector 400. Receiving volume 510 has a widened section 520 for receiving head portion 410 of the male connector and a narrowed portion 530 for receiving stem portion 420 of male connector 400. When being connected for locking, head 410 fits in to female connector 500 at the widened portion 520 and when the two connectors are rotated to engage, stem 420 slides into narrowed portion 530 into its locked position. Also shown in this embodiment are the outer connection collar 200 and pre-cut slots 300 for attaching to an article.

Reference is next made to FIGS. 23-27 in which another hermaphroditic connector constructed in accordance with another preferred embodiment of the invention is depicted. In the embodiment of FIGS. 23-27 an additional locking feature is found at the perimeter of connector 550. In addition to the connection elements in the center of the connector which engage in a male and female fashion as described above, although with a slightly different configuration, the outside perimeter of the connectors include a series of curved surfaces 110 between curved cutout portions 120 designed to engage with a cylindrical closure element 105 on the flexible arm 100 shown extending from the perimeter of the connector having a convex surface 102. It is noted that cylindrical locking member 105 on flexible arm 100 has a cylindrical height h greater than the thickness of the main connector body so that a locking cylindrical member may lock together both connectors 550 with the single cylindrical locking piece.

Figure 25:
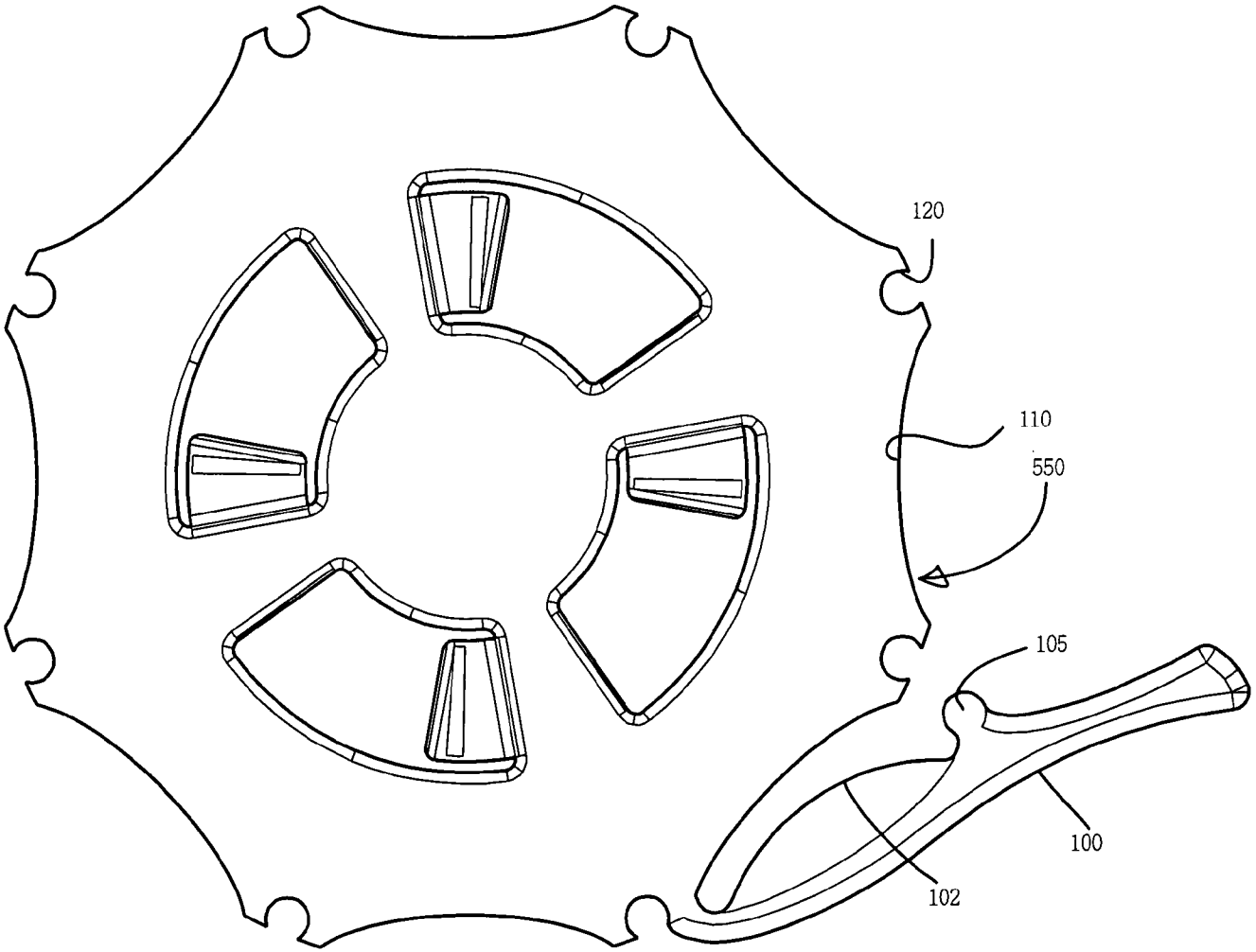
FIG. 25 is a bottom plan view of the connector of FIG. 23.
Figure 26:
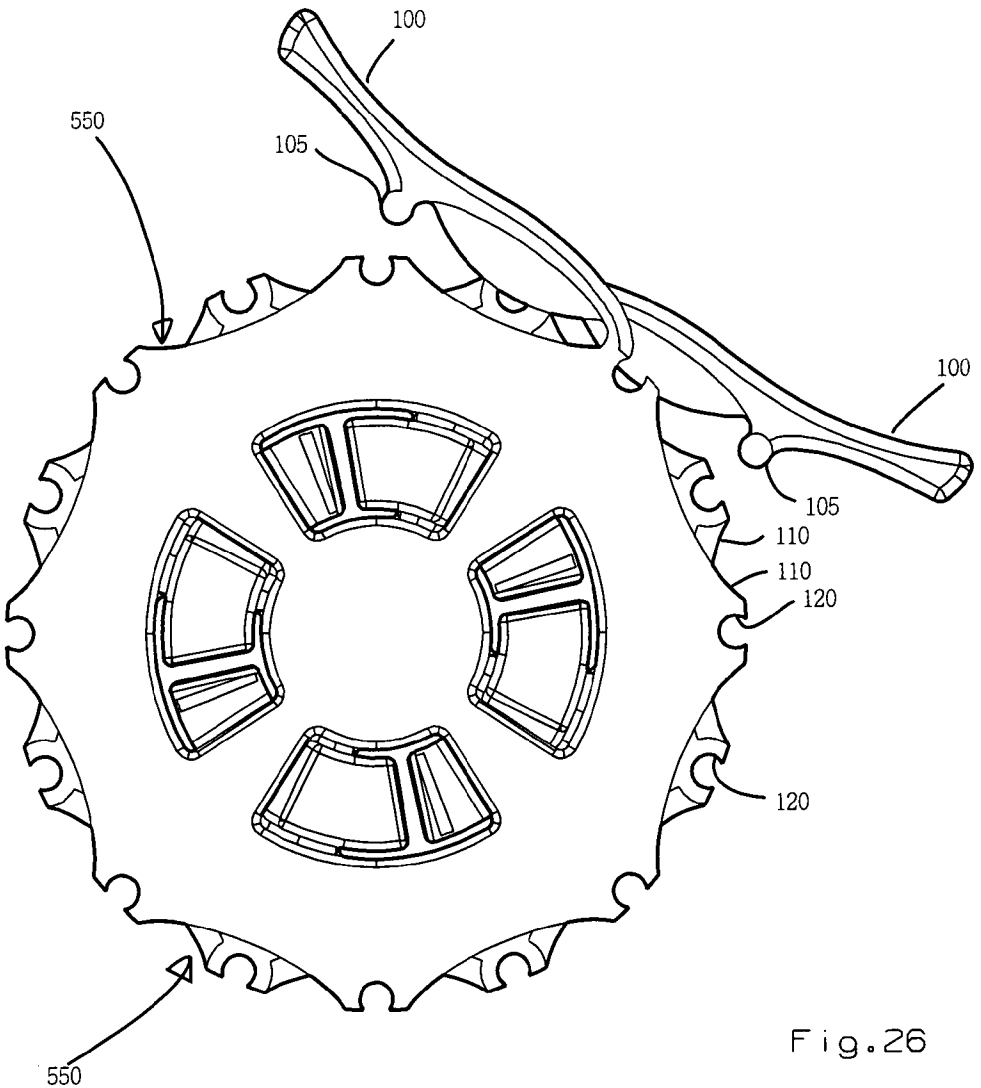
FIG. 26 is a top plan view of two connectors of the type shown in FIG. 23 placed together to begin locking them to each other.
Figure 27:
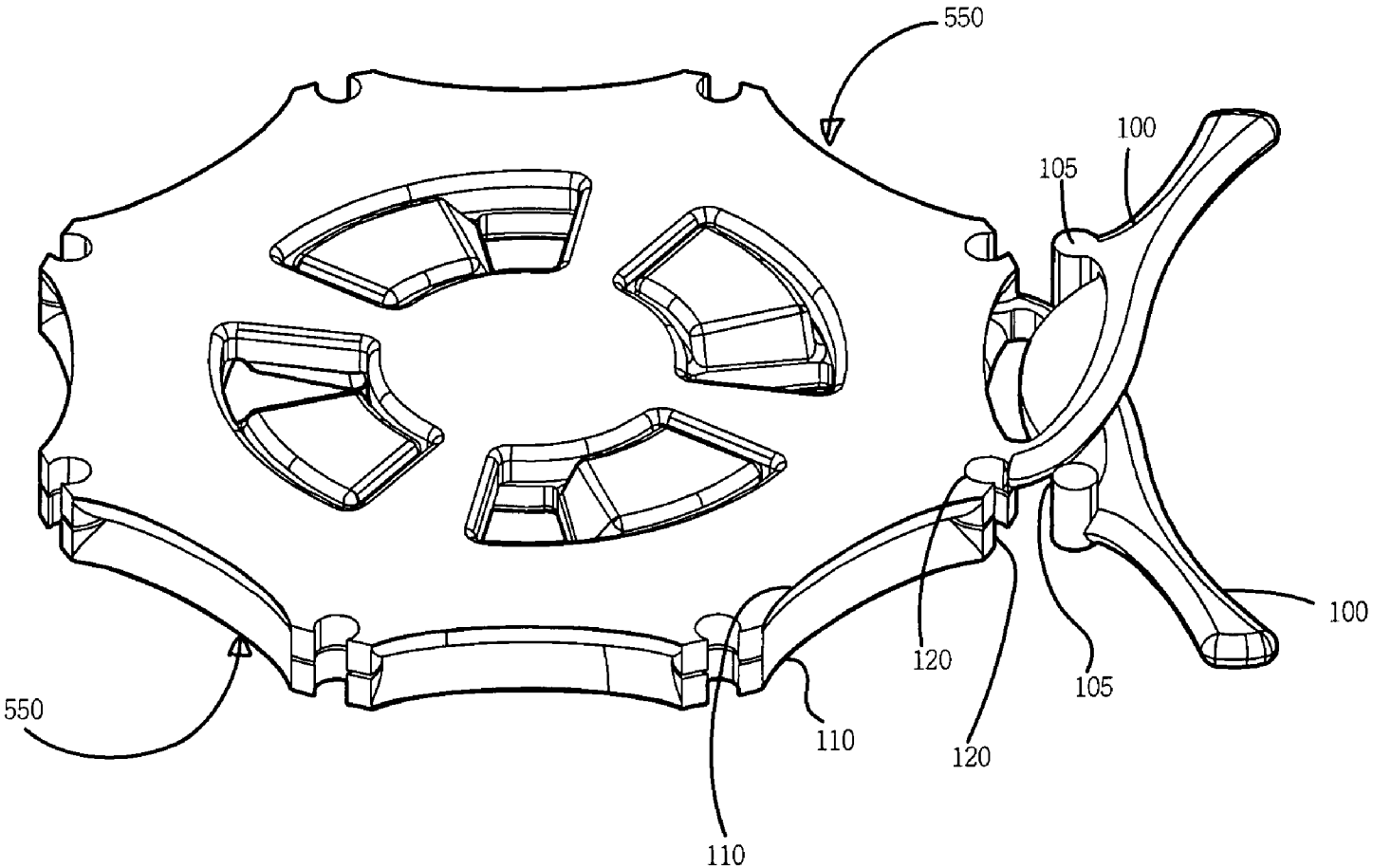
FIG. 27 is a perspective view similar to the top plan view of FIG. 26.

FIG. 25 shows the connector from the bottom and shows the way in which the connector elements fit into each other and engage. The connection of two connectors is shown in two separate positions in FIGS. 26 and 27. The two connectors are fully engaged by twisting the two connectors relative to each other so that the circular receiving openings around the perimeter of the connector align and are positioned in a way so that the two locking arms 100 of the connectors can be rotated until cylindrical locking members 105 can be pushed into circular openings 120 which align. In the locked position, the cylindrical member extends across the boundary between the two connectors and the two locking cylindrical members anchor the two connectors in a fashion which assures that the connectors cannot be rotated with respect to each other until the locking arms are removed from the circular members.

Various changes can be made in the patterns of the male and female connection elements to achieve a similar result in which the male component engages with the female component and then locks in place without slipping or casually engaging without an intentional torsion in the opposite direction by the user.

Accordingly, an improved, releasable connector formed from a pair of hermaphroditic connectors is provided.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A connection system for securing two articles to each other comprising:

two connectors, each having:

a base plate with a center point;

substantially identical inter-engaging sections with at least one male component and at least one female component; and a connection region for securing to an article, wherein each of the connectors further comprises an outer connection tab disposed around a portion of the base plate, the outer connection tab includes a pre-cut slot and a release flange, the pre-cut slot of each of the connectors align when the connectors are locked, and the release flange extends beyond the tab of the other connector to facilitate disengagement of the connectors.

2. The connection system according to claim 1, wherein the male and female components are radially disposed equidistant round the center of the base plate and the connection region is disposed circumferentially around the male and female components.

3. The connection system of claim 2, wherein the male component comprises a curved ramp member having an interior surface and the ramp having a radially inwardly oriented section towards a center of the connector; and the female component comprises a curved ramp member having an interior surface and the ramp terminating at the end of the arc of the ramp.

4. The connection system of claim 1, wherein the release flange includes at lease on elongated raised hatching region.

5. The connection system of claim 4, wherein the connection tab includes a ramp having a lower engagement end and a raised locking end for connecting to the other connector.

6. The connection system of claim 4, wherein the connection tab includes a lip disposed in the area of the lower engagement end for releasable locking with the raised locking end such that when the connectors are rotated the raised locking end snaps into place at the lower engagement end with the lip.

7. The connection system of claim 3, wherein the male component further comprises a positive locking element.

8. The connection system of claim 3, wherein the female component further comprises a positive locking element.

9. The connection system of claim 7, wherein the female component further comprising a negative locking element for engagement with the positive locking element on the male component.

10. The connection system of claim 1, wherein the interengaging section further comprises at least on ramp for facilitating connection of the connectors.

* * * * *